United States Patent [19]

Leopoldi et al.

[11] Patent Number: 4,768,138

[45] Date of Patent: Aug. 30, 1988

[54] FLASHLIGHT

[75] Inventors: Norbert Leopoldi, Chicago; William P. Heinrich, McHenry, both of Ill.

[73] Assignee: The Cloverline, Inc., Chicago, Ill.

[21] Appl. No.: 81,684

[22] Filed: Aug. 5, 1987

[51] Int. Cl.[4] ..... F21L 7/00

[52] U.S. Cl. ..... 362/189; 362/202; 362/205

[58] Field of Search ..... 362/189, 202, 205, 200

[56] References Cited

U.S. PATENT DOCUMENTS

| | | | |
|---|---|---|---|
| 3,711,703 | 1/1973 | Bacevius | 362/189 |
| 4,122,510 | 10/1978 | Halliday, Jr. | 362/189 |
| 4,237,527 | 12/1980 | Breedlove | 362/189 |
| 4,347,553 | 8/1982 | Saron | 362/189 |
| 4,348,715 | 9/1982 | Christensen et al. | 362/202 |
| 4,399,495 | 8/1983 | Leopoldi et al. | 362/189 |
| 4,517,628 | 5/1985 | McDermott | 362/202 |
| 4,559,588 | 12/1985 | Engelson et al. | 362/189 |
| 4,644,451 | 2/1987 | Chabria | 362/189 |

*Primary Examiner*—E. Rollins Cross

*Attorney, Agent, or Firm*—Milton S. Gerstein

[57] ABSTRACT

A squeeze-on flashlight in which a pair of batteries is provided in a plastic housing, one of the batteries having an outer metallic covering for selective electrical connection with a pair of elongated flexible finger elements positioned about the one battery. The finger elements extend from a spiral mount formed by a pair of loops which loops threadingly receive the threaded mounting cap of a light bulb mounted at the end of the housing remote from the end housing the one battery. By squeezing the outer plastic housing, the finger elements are urged into contact with the outer metallic cover of the one battery, to thereby close an electric circuit in series with the light bulb.

1 Claim, 1 Drawing Sheet

10
12
14
14'
15
16
18
20
22
24
30
40
44
46

FLASHLIGHT

BACKGROUND OF THE INVENTION

The present invention is directed to a flashlight of the type disclosed in U.S. Pat. No. 4,399,495. The flashlight disclosed therein is a hand-held flashlight having an outer casing made of flexible plastic which allows for the squeezing thereof by a hand, in order to establish a closed electric circuit between a battery mounted within the plastic casing and a miniature light bulb, to thereby actuate the miniature light bulb simply by squeezing the outer plastic casing thereof. The closed circuit is achieved by a plurality of flexible metallic fingers formed by an inner metal casing surrounding a battery, which battery has its outer, insulating cover absent, to thereby expose its metallic core about which metallic core are circumscribed the metallic fingers of the inner metal casing. At the end of the inner metal casing, remote from the flexible metallic fingers, the inner metal casing threadingly and removably mounts the threaded metallic cap or contact of the miniature light bulb, such that the anode of the battery housed in the inner metal casing abuts up against the metallic cap of the bulb, so that when the outer plastic casing is squeezed, a return path is provided to complete the electrical circuit and, thus, illuminate the bulb. However, since the inner metal casing housing the battery is of relatively unusual configuration, it has proven relatively difficult and costly to manufacture.

SUMMARY OF THE INVENTION

It is, therefore, the primary objective of the present invention to provide an improved squeeze-on flashlight in which the inner metal casing is obviated and replaced by a plurality of metallic fingers extending the entire length of the batteries housed within the outer plastic casing, which plurality of fingers are connected at one end to a spiral metal connection in which is removably threaded the threaded cap of a light bulb, in order to provide a structure that is relatively easy and inexpensive to manufacture. One of the two batteries in the casing has its outer insulating cover removed, with the flexible metallic fingers being spaced therefrom by a spacer disc. The other battery is provided with its insulating cover.

BRIEF DESCRIPTION OF THE DRAWING

The invention will be more readily understood with reference to the accompanying drawing, wherein.

DETAILED DESCRIPTION OF THE INVENTION

Figures 1, 2, 3, 4, 5:
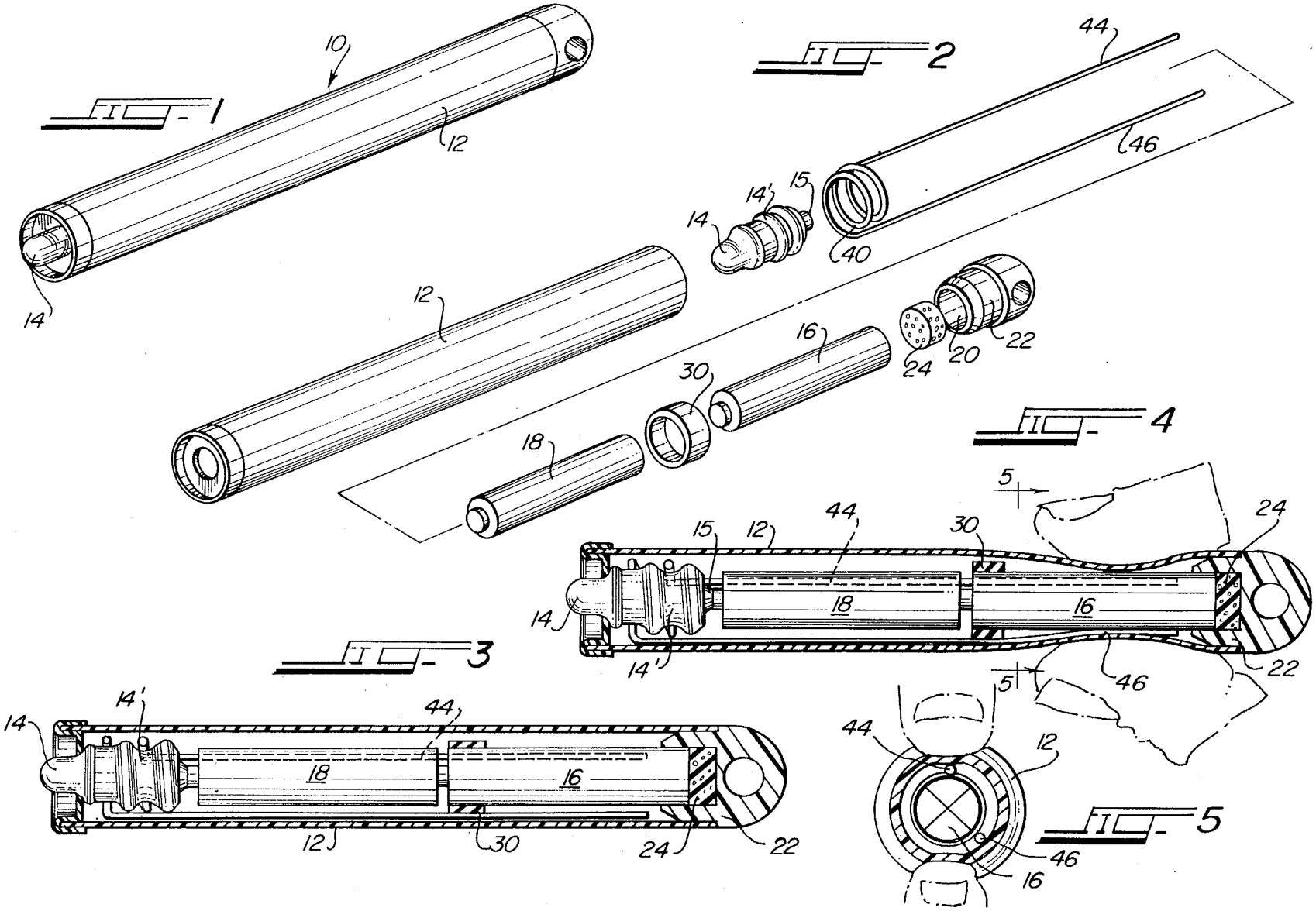
FIG. 1 is a perspective view of the flashlight of the invention.
FIG. 2 is an assembly view of the parts thereof.
FIG. 3 is a longitudinal cross-sectional view thereof.
FIG. 4 is a broken-away view showing the inner parts thereof, with the flexible metallic fingers flexed inwardly for operating the flashlight of FIG. 1.
FIG. 5 is a cross-sectional view taken along line 5—5 of FIG. 4.

Referring now to the drawing in greater detail, the hand-held flashlight of the invention is indicated generally by reference numeral 10. The flashlight 10 includes an outer hollow casing or housing 12 made of flexible plastic so that upon the squeezing of it, it may be bent or flexed inwardly, as shown in FIG. 4. The housing 12 has at one end an opening through projects a light bulb 14 which has a threaded mounting cap or sleeve 14' projecting therefrom in the conventional manner. Housed within the casing or housing 12 are a pair of batteries 16, 18, with the battery 16 having its outer insulating cover or jacket removed, in the manner described in U.S. Pat. No. 4,399,495. The other battery 18 is a standard battery with its outer insulating cover or jacket present. Thus, the diametric extension of the battery 18 may be somewhat greater than that of the battery 16. The other end of casing is provided with an interior well or recess 20 formed by the hollow annular piece 22 in which is received resilient pressure pad 24 for biassing the series-connected batteries 16, 18 forwardly into electrical connection with the terminal 15 of the light bulb. Surrounding the forward end portion of the battery 16 is an annular spacing ring 30 preferably made of flexible plastic or other electrically-insulating material.

Provided in the housing 12 is a spiral metal coil 40 defining a pair of spiral loops, as best seen in FIG. 2. The diametric extension of these two loops are such as to threadingly receive the outer threads of the mounting cap 14' of the light bulb, as shown in FIG. 3, to thereby provide an electrical connection therewith. Projecting from each loop is an elongated flexible metallic finger or clip 44, 46, extending from the respective loops such that they are spaced an arcuate distance apart of approximately 135 degrees. Each elongated flexible finger or clip 44, 46 extends substantially along most of the length of the casing 12, and has a free end portion thereof juxtapositioned adjacent the rear end portion of the battery 16. Thus, when the outer casing 12 is gripped by a pair of fingers of a hand, as shown in FIG. 4, the squeezing thereof will cause the end portions of the clips 44, 46 to abut up against and contact the exposed metallic casing of the battery 16, to thus close a circuit, to thereby light the bulb 14. The substantially 135 degree spacing of the two clips or fingers 44, 46 will ensure that for all hand-gripping orientations about the casing 12, at least one of the clips 44, 46 will contact the bared battery 16. Of course, more than two clips 44, 46 may be provided, and the angular spacing therebetween may be varied.

If the diametric extension of the battery 18 is made larger than that of the battery 16, the battery 18 also serves to prevent contact of the clips of fingers 44, 46 with the outer metallic cover of the battery 16, in addition to such result effected by the annular ring 30.

While a specific embodiment of the invention has been shown and described, it is to be understood that numerous changes and modifications may be made therein without departing from the scope and spirit thereof as set forth in the appended claims.

What is claimed is:

1. A squeeze-on flashlight, comprising;

a hollow main housing;

a first battery housed within said housing;

bulb means mounted at one end of said housing, said bulb means having a threaded cap means for mounting purposes;

means urging said first battery toward said cap means for providing electrical connection therebetween;

said first battery comprising an outer, exposed cover of metal;

switch means for mounting said cap means and for effecting the energization of said bulb means, said means for mounting comprising a spiral means comprising at least two loops thereof, each of said loops having an inner diametric extension for threadingly receiving therein the threads of said threaded cap means, said means for mounting further comprising two elongated flexible coil-wire finger elements integrally connected with and projecting from said at least two loops, one said finger element projecting from one said loop, and another said finger element projecting from another said loop;

each said finger element extending substantially along the length of said housing and defining a free end portion juxtapositioned adjacent a first end portion of said first battery for movement toward and away from said first battery;

an annular spacing ring circumscribing a second end portion of said first battery for normally spacing each said free end portion from the outer cover of said first battery;

said housing being made of flexible electrically-insulating material, whereby upon the squeezing of said housing, said flexible finger elements are caused to touch the outer metallic cover of said first battery to close a circuit in series with the bulb means;

a second battery mounted in series with said first battery in said housing having an outer electrically-insulating cover, said second battery being mounted closer to said cap means than said first battery;

said spacing ring being positioned about said second end portion of said first battery adjacent said second battery;

said second battery having a diametric extension greater than that of said first battery;

said two finger elements being arcuately spaced about said first and second batteries along substantially the entire lengths of both.

* * * * *